United States Patent [19]

Bruer

[11] Patent Number: 4,571,908

[45] Date of Patent: Feb. 25, 1986

[54] FORMWORK ELEMENT OF BRICK SIZE

[76] Inventor: Manfred Bruer, Postfach 63 12 27, D-6204 Taunusstein 1, Fed. Rep. of Germany

[21] Appl. No.: 601,491

[22] Filed: Apr. 18, 1984

[30] Foreign Application Priority Data

Apr. 21, 1983 [DE] Fed. Rep. of Germany ..... 3314516

[51] Int. Cl.[4] ..... E04C 1/00

[52] U.S. Cl. ..... 52/309.4; 52/438

[58] Field of Search ..... 52/309.4, 309.9, 309.12, 52/238.1, 405, 437, 438, 606

[56] References Cited

U.S. PATENT DOCUMENTS

| | | | |
|---|---|---|---|
| 3,846,949 | 11/1974 | Okawa | 52/438 |
| 4,223,501 | 9/1980 | DeLozier | 52/309.12 |
| 4,433,521 | 2/1984 | Dietrich | 52/405 |

*Primary Examiner*—Norman Morgenstern
*Assistant Examiner*—K. Jaconetty
*Attorney, Agent, or Firm*—Balogh, Osann, Kramer, Dvorak, Genova & Traub

[57] ABSTRACT

The formwork element of brick size is intended to form horizontal wall projections on which e.g. an outer clinker masonry can be bricked up. The formwork element comprises an inner wall (10), an outer wall (12) connected therewith via stems (42,44,45) and an outwardly projecting formwork part (14). The cavity of the latter, via one or several breaks (24,26) provided in the outer wall (12), is in communication with the interspace between the latter and the inner wall (10). In order to adjust the load-bearing part of the inner wall (10) to the part (28,30,32) of reduced load-bearing capacity of outer wall (12) and to avoid a sloping position of the wall, inner wall (10) at least on the upper side in the area (60,62) opposite break (24,26) of the outer wall (12) is depressed, with the close tongue-grooving engagement (16,20) being maintained. The protruding form-locking part (14), on the bottom side, is formed in a manner rising in oblique upward direction.

4 Claims, 2 Drawing Figures

FORMWORK ELEMENT OF BRICK SIZE

Figure 1:
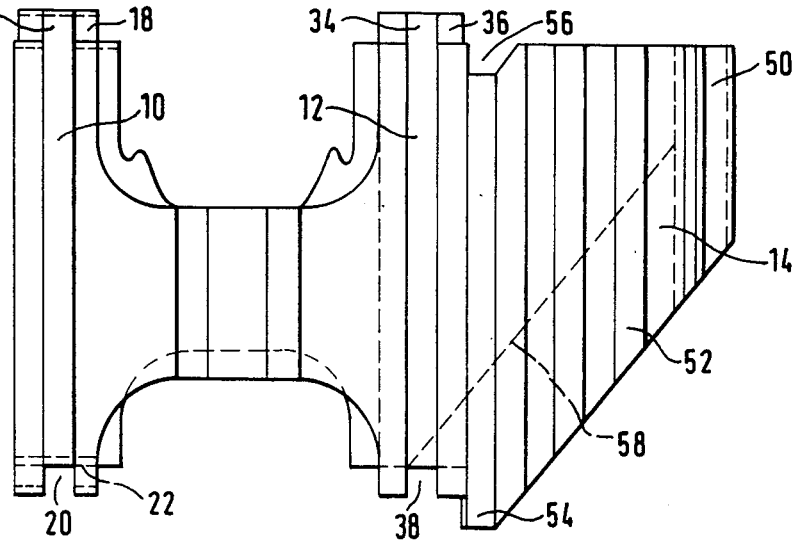

The present invention is concerned with a formwork element of brick size for forming horizontal wall projetions, e.g. for supporting on outer wall covering or facing, comprising an inner wall the upper side of which is formed with a tongue and/or groove extending along the length thereof, for form-locking engagement with formwork elements of the next row, a discontinuous outer wall connected via stems to the inner wall, and an outwardly projecting formwork element the cavity of which via the break in the outer wall is in communication with the interspace between the latter and the inner wall.

Such formwork elements, conventionally, have been made of concrete or light-weight concrete. They envolve the disadvantage that along the bottom edge of the bricked up clinker masonry, they form a cold bridge, especially so as the wall projection, normally, is disposed in the areas of the basement ceiling. To avoid cold bridges, the formwork elements could be made from a material of a higher heat insulating capacity. However, such materials, e.g. hard foam, are of a relatively low strength. This strength would not be adequate for the contemplated purpose if the shapes developed for formwork elements of concrete or light-weight concrete, were to be readily adopted. This, on the one hand, is due to the fact that the formwork elements have to transfer via their mutual bearing faces, amazingly high forces. For, they are not only loaded by their dead weight but also by a part of the weight of the cast concrete as the latter already during settling will adhere to the inner walls of the formwork elements. In normal formwork elements, these forces uniformly load the inner and outer walls as they are essentially of an identical strength. However, in formwork elements of the type presently under consideration, the outer walls as a result of the breaks provided therein, toward the projecting part, are discontinued and reduced to the supporting points remaining between the breaks. Under the load occurring in practice after filling with concrete, light-weight, highly heat insulating formwork elements would be more heavily compressed at the remaining supporting points of their outer walls than at the inner walls load-bearing along the entire length thereof. This would result in a curved wall.

In addition, the concrete flowing in the projecting formwork part would load the remaining parts of the outer wall of the formwork element.

It is the object of the present invention to provide a formwork element of the afore-mentioned type which despite its light weight and high heat insulating properties is not subject to the one-sided deformation referred to; this problem, in accordance with the invention, is solved in that the formwork element is made of hard foam and that the bearing surfaces on the upper side of the inner wall for formwork elements of the following row in the region opposite the break of the outer wall are lowered by less than the height of the tongue or groove but to such an extent that the load-bearing faces of the inner wall and of the outer wall substantially are equal-sized.

Accordingly, the invention does not make an attempt to prevent or reduce by reinforcements in the area of the outer wall of the formwork element the increased deformation occurring there between the breaks. The solution rather resides in that also the load-bearing surface of the inner wall is reduced substantially to the same extent as on the part of the outer wall. Hence, substantially the same deformations occur on the inner wall as on the outer wall of the formwork element as a result of which also the cast wall over the protruding formwork elements will remain in the vertical position and need not be supported.

A deliberate lowering of predetermined surface areas of the inner wall of the formwork element will be performed to such an extent only that the groove and tongue engagement and, hence, the close connection of the superposed formwork elements will be maintained.

According to a preferred embodiment of the invention, moreover, the new protruding formwork element is distinguished from the prior art constructions in that the protruding formwork part is formed in a manner obliquely rising outwardly from bottom to top. In this manner, as compared with a protruding formwork part of rectangular cross-section, per running meter about 100 kg concrete can be saved. The moment loading the light-weight walls of the formwork element is correspondingly lower.

After the invention having provided the possibility to produce protruding formwork elements from hard foam of high heat insulating properties, further use can be made of the fact that the material is easy to saw up. In a preferred practical embodiment, the formwork element on the upper side is, therefore provided with marking grooves substantially extending to the outer corners, which marking grooves, with the longitudinal direction of the formwork element form an angle of 45°. It is possible to form protruding corners with protruding formwork elements cut to mitre in accordance with the marking grooves. The afore-described simple solution envolves the advantage that despite the relatively complicated form of the protruding formwork elements no special formwork is required for the protruding corners; the normal forward elements will rather be adequate.

Figure 2:
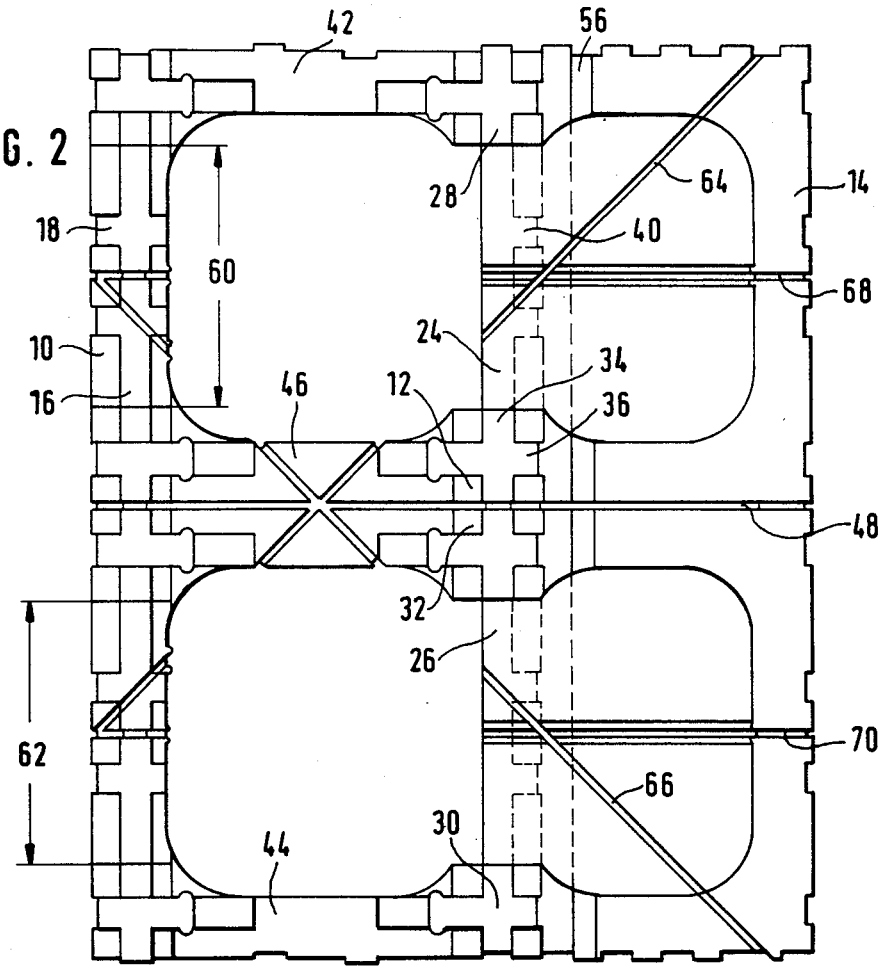

The invention will now be described in greater detail with reference to a form of embodiment as illustrated in the drawing, wherein FIG. 1 is a side view of a protruding formwork element;

FIG. 2 is a plan view of the formwork element according to FIG. 1.

The formwork element as shown in the drawing, conventionally, has an inner wall 10, an outer wall 12 and a protruding formwork part 14. While the inner wall 10 along the entire length thereof on the upper side is provided with a longitudinal tongue 16 and several transverse tongues 18 and, on the bottom side, with a corresponding longitudinal groove and a plurality of transverse grooves 32 corresponding to transverse tongues 18 and shown in FIG. 1 in dashed lines, as is common practice with formwork elements of hard foam, outer wall 12 comprises two large breaks 24,26 with the consequence that the two end areas 28 and 30 and a central area 32 in the form of pillars are the only parts left from outer wall 12. This remainder 28,30,32 of the outer wall, in the same manner as inner wall 10, on the upper side is provided with a longitudinal tongue 34 discontinued by breaks 24,26, and with a plurality of transverse tongues 36, while the bottom side is formed with a corresponding longitudinal groove 38 and transverse grooves 40 shown in dashed lines in FIG. 2.

Inner wall 10 and outer wall 12 are interconnected by end stems 42 and 44 and by a central stem 46. The latter is, as shown by the plan view, twice as wide as the end stems 42,44; provided on the upper side thereof is a marking groove 48 indicating how to saw up the formwork element exactly in the center, i.e. bisecting the same. The shape of stems 42,44,46 is known with standard non-protruding formwork elements of hard foam. They are of a substantially lower height than the inner and outer walls in order that the concrete during filling up the wall can flow from one formwork element to the next one in the row. At the ends of a row, the end stems can be brought into engagement with matching insert elements (not shown) in order to attain closed end walls.

The protruding formwork part 14 is formed by extensions of stems 42,44,46 extending outwardly and by a wall portion interconnecting the said extensions and extending in the longitudinal direction, which wall portion is comprised, as shown by FIG. 1, of an upper, vertical wall area 50 and a lower, oblique wall area 52. The latter, at the bottom end thereof passes over into outer wall 12 while forming ahead thereof a lower lug 54 getting into abutment with the outer side of the formwork element disposed therebelow, hence, offering an improved support of the protruding formwork part. Moreover, in this manner, an increased wall strength of the latter can be attained thereby, thus improving the sealing against the row of formwork elements therebelow. On the upper side, the outer extensions of stems 42,44,46 above nose 54, are provided with grooves 56 corresponding to the nose 54 thereby attaining that a multiplicity of protruding formwork elements of the shape as shown during intermediate storage and transport can be nested in space-saving manner.

It is apparent that after filling of a wall formed by formwork elements, the concrete forms a horizontal outer wall projection which, in cross section, is bevelled on the lower side as shown in FIG. 1 by the dashed line 58. The concrete in the protruding formwork part 14, via breaks 24,26, is in communication with the concrete in the interspace between inner wall 10 and outer wall 12.

The pillar-type narrow areas 28,30,32 of outer wall 12 as left between breaks 24,26, under the relatively heavy load of the concrete filled in, will compress in the vertical direction. In order to avoid that this deformation be not in excess of that on the part of the inner wall 10, those wall areas of the latter that are located opposite recesses 24 and 26 are designated in FIG. 2 by reference numerals 60 and 62 inclusive of the tongues and grooves provided there, are set back by respectively e.g. 5 mm, as shown in dashed lines in FIG. 1. By so setting back the surface areas of the inner wall 10 respectively over recesses 24 and 26 it will be attained that on the part of the inner wall, an equal-sized wall cross section will have to receive the vertical load as on the part of the discontinuous outer wall 12. Consequently, the deformations of the inner wall 10 and of the outer wall 12 are equal in size safeguarding that the wall will remain vertical.

As shown by the dashed lines on tongues 16,18 and grooves 20,22 in FIG. 1, it is also in the set back, i.e. depressed surface areas 60 and 62 that the close tongue-grooving engagement of the inner wall of the protruding formwork elements with the inner wall of the formwork elements disposed thereabove and therebelow and forming the wall formwork, will be maintained.

For forming the outer wall projection on external corners, no special additional formwork elements will be required as the one as shown can be readily mitre-cut and then composed with another mitre-cut element to form a corner. How to make such mitre-cuts, is shown by formed-in marking grooves 64,66 forming with the longitudinal direction of the formwork element an angle of 45° and crossing at right angles centrally of the middle stem 46. Further marking grooves 68 and 70 will offer additional possibilities of reducing the formwork element by a quarter and to a quarter, respectively.

In deviation from the form of embodiment as illustrated in the drawing, depending on the load and strength of the material as contemplated, it may be sufficient if only on the upper side or only on the bottom side of the formwork element the inner wall is depressed in the areas opposite recesses 24 and 26 of the outer wall. Results practically useful in the sense of the invention can already be attained if the wall areas of the inner wall taking up the load are not exactly of the same size as those of the outer wall.

The slope of protruding element 14 of the formwork element as shown at 58, is considered to be a new measure extremely beneficial also in respect of formwork elements of concrete and light-weight concrete or other materials, which irrespective of the load-carrying capacity of the walls of the formwork element, will bring about substantial concrete savings.

I claim:

1. A formwork element of brick size for forming horizontal wall projections, e.g. for supporting an outer wall covering or facing, comprising an inner wall the upper side of which is formed with a tongue and/or groove extending along the length thereof for form-locking engagement with formwork elements of the next row, a discontinuous outer wall connected via stems to the inner wall and an outwardly protruding formwork part having a cavity which via a break in the outer wall is in communication with an interspace between said outer wall and the inner wall, characterized in that said element is made of hard foam and a bearing surface on an upper side of the inner wall of formwork elements of the next row in an area opposite a break in the outer wall is lowered by less than the height of a tongue or groove but to such a degree that the load-bearing surfaces of the inner wall and of the outer wall are substantially equally loaded.

2. A formwork element according to claim 1, characterized in that the inner wall on a bottom side of said area opposite said break in the outer wall is depressed so that load-bearing faces on the bottom side substantially are of the same size as on the upper side of the inner wall.

3. A formwork element especially according to claim 1, characterized in that a protruding formwork part is formed in a manner rising from bottom to top in oblique outwardly direction.

4. A formwork element according to claim 1, characterized in that the upper side of the element is provided with marking grooves substantially extending to outer corners, which marking grooves with the longitudinal direction of the formwork element form an angle of 45°.

* * * * *